United States Patent [19]

Kitsuda

[11] Patent Number: 5,004,117

[45] Date of Patent: Apr. 2, 1991

[54] SAFETY CYLINDER CAP

[76] Inventor: Sakae Kitsuda, 1-3-5 Nishiyawata, Hiratsuka, Japan

[21] Appl. No.: 412,162

[22] Filed: Sep. 25, 1989

[51] Int. Cl.[5] ..... B65D 25/00

[52] U.S. Cl. ..... 220/85 P; 137/382

[58] Field of Search ..... 220/85 P, 85 D, 85 E, 220/85 K; 137/382

[56] References Cited

U.S. PATENT DOCUMENTS

| | | | |
|---|---|---|---|
| 3,006,360 | 10/1961 | Oxenham | 220/85 P X |
| 3,372,836 | 3/1968 | Smith | 220/85 P |
| 3,776,412 | 12/1973 | Mink | 220/85 P |
| 4,103,806 | 8/1978 | White | 220/85 P X |
| 4,332,331 | 6/1982 | Fawley | 220/85 P |
| 4,521,676 | 6/1985 | Poulsen | 220/85 P X |
| 4,600,033 | 7/1986 | Baron | 220/85 P X |
| 4,664,286 | 5/1987 | Winkelmann et al. | 220/85 P |
| 4,741,457 | 5/1988 | Joseph et al. | 220/85 P X |

*Primary Examiner*—Steven M. Pollard
*Attorney, Agent, or Firm*—James E. Brunton

[57] ABSTRACT

A cylinder cap and method of making the same for use with gas cylinders of standard construction to protect the cylinder valve from damage should the cylinder be knocked over or dropped. The cylinder cap is uniquely formed to allow convenient access to the cylinder valve without having to remove the cap from the cylinder. A gripping member is provided in the cylinder valve access aperture of the bell-shaped cap for use in safely transporting the gas cylinder. In accordance with the method of the invention, the apertured, bell-shaped body of the cap is formed from a single sheet of planar material by means of a series of drawing and piercing steps.

7 Claims, 3 Drawing Sheets

SAFETY CYLINDER CAP

BACKGROUND OF THE INVENTION

1. Field of The Invention

The present invention relates generally to a cap for protecting the cylinder valve of a gas cylinder. More particularly, the invention concerns a safety cap and the method of making the same for use in connection with portable gas cylinders which positively protects the cylinder valve against damage and, at the same time, permits ready access thereto.

2. Discussion of The Invention

Introduction

Gas cylinders typically comprise strong steel vessels of cylindrical shape in which gases are stored under high pressure. Provided at one end of the gas cylinder is a necked down portion having a cylinder valve including a valve outlet fitting to which a pressure regulator or the like can be connected. A hand-wheel for operating the valve is typically permanently attached to the valve stem.

Threads on the necked down portion of the cylinder provide a means whereby a heavy steel cap is screwed over the valve to protect it from injury during shipment. If the cylinder valve should ever be broken off, the very high pressure of the gas in the cylinder, under escaping tends to give the cylinder rocket propulsion. Because of this danger, it is essential that the cap be in place during shipment and handling of the gas cylinder.

In the past, the cylinder cap has traditionally been made in a generally cylindrical configuration closed at its upper end by a heavy dome shaped wall and open at its lower end for threaded interconnection with the necked down portion of the gas cylinder. Typically, vertically extending, slot-like openings are provided in the wall of the cap to permit release of gas. To gain access to the cylinder valve it is necessary to remove the cylinder cap. This is highly undesirable because removal of the cap exposes the cylinder valve to damage and the resultant possibility of a catastrophic accident. Additionally, the configuration of the prior art cylinder cap makes handling of the cylinder difficult since no safe gripping surface is provided on the cap.

The device of the present invention uniquely overcomes the drawbacks of the prior art cylinder caps by providing a cylinder cap of a novel configuration which permits ready access to the cylinder valve and also provides a built-in hand grip that makes handling of the gas cylinder considerably easier and safer.

SUMMARY OF THE INVENTION

It is an object of the present invention to provide a safety cylinder cap for use with gas cylinders to protect the cylinder valve, in which the cap need not be removed from the gas cylinder to gain access to the cylinder valve.

Another object of the invention is to provide a cylinder cap of the aforementioned character which includes a conveniently located gripping member for use in transporting the gas cylinder.

Another object of the invention is to provide a safety cylinder cap which is configured to protect the cylinder valve should the gas cylinder fall over or be dropped during transport.

Still another object of the invention is to provide a method for making a safety cylinder cap of the character described in which the apertured, a bell-shaped body of the cap is formed from a single sheet of planar material.

Yet another object of the invention is to provide a method described in the preceding paragraph which enables the cylinder cap to be expeditiously manufactured at low cost.

BRIEF DESCRIPTION OF THE DRAWINGS

FIG. 15 is a side elevational cross sectional view illustrating the ninth step of the method of the invention.

DESCRIPTION OF THE INVENTION

Figure 1:
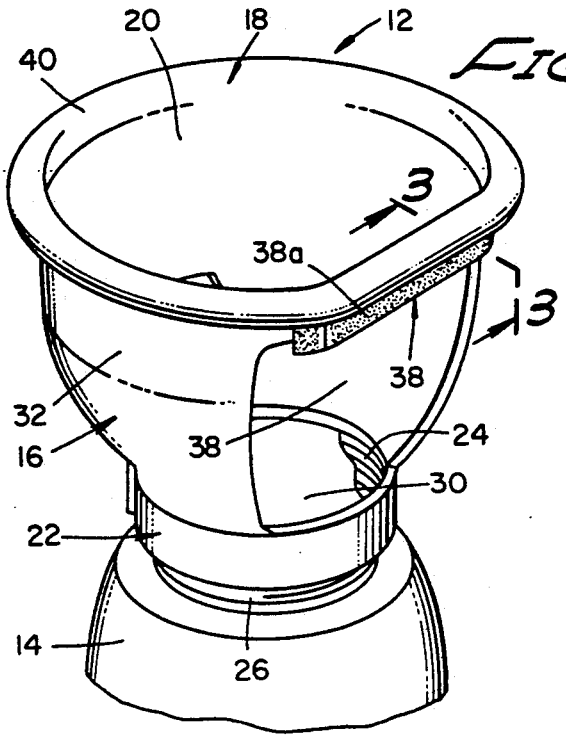
FIG. 1 is a generally front perspective view of the safety cap of the present invention shown connected with a gas cylinder of the character used to contain compressed gas.
Figure 2:
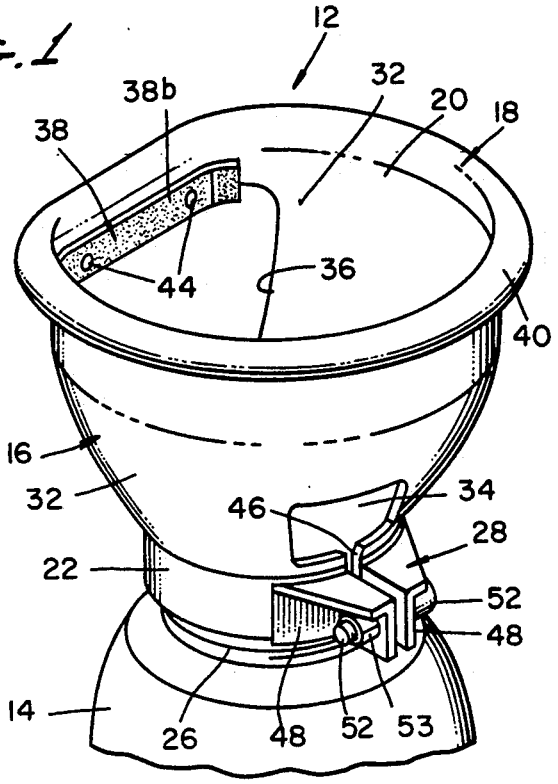
FIG. 2 is a generally rear perspective view of the safety cap.

Referring to the drawings and particularly to FIGS. 1 and 2, the safety cylinder cap of the present invention is there illustrated and generally designated by the numeral 12. The safety cap 12 is shown in threaded interconnection with a gas cylinder 14 of standard construction. In the embodiment of the invention shown in FIGS. 1 and 2, the safety cap comprises a generally bell-shaped body 16 including a first end portion 18 having a first opening 20 of a first size. Safety cap 12 also includes a generally cylindrically shaped, second end portion 22 which is of a second size smaller than the size of opening 20. End portion 20 includes an internal wall 24 which is threaded for interconnection with the threads 26 provided on gas cylinder 14.

As best seen by referring to FIG. 2, adjustment means, generally designated by the numeral 28, are provided for adjusting the size of the second opening 30 of the device. A curved side wall 32 interconnects first and, second end portions 18 and 22 and is provided with a first aperture 34 (FIG. 2) and a second oppositely disposed larger aperture 36 (FIG. 1). Provided proximate the upper margin of aperture 36 is a grip, or finger engaging means for engagement with the fingers of a person lifting the safety cap and the safety cap interconnected with the gas cylinder 14. In the present embodiment of the invention, the finger engaging means is provided in the form of an elongated plastic gripping member 38 having a longitudinally extending slot 39 which defines a pair of spaced apart walls 38*a* and 38*b*. Slot 39 is of a width to closely receive the edge of the curved side walls 32 disposed proximate the upper portion of aperture 36.

Figure 3:
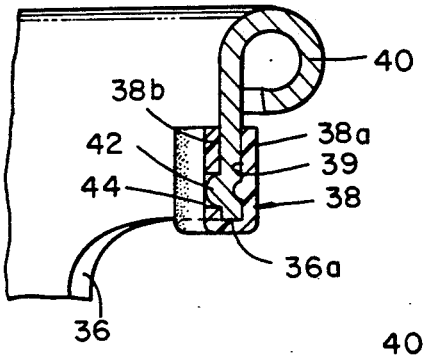
FIG. 3 is a greatly enlarged fragmentary cross sectional view taken along lines 3—3 of FIG. 1.
Figure 4:
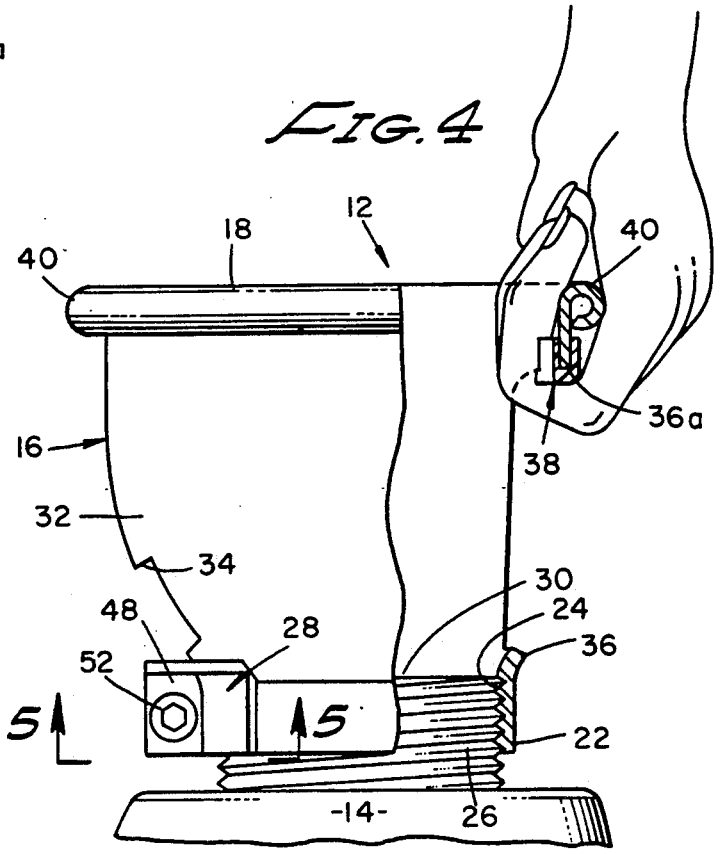
FIG. 4 is a side elevational, diagrammatic view of the safety cap partly in cross section to illustrate the configuration of the gripping portion of the device.

As best seen by referring to FIG. 3, the upper margin of wall 32 is provided with peripherally extending, rounded bead portion 40. Provided proximate the edge 36*a* of aperture 36 is a pair of spaced apart, inwardly protruding protuberances 42 which are closely received within a pair of apertures 44 formed in the rear wall 38*b* of gripping member 38 (FIG. 2). Protuberances 42, in cooperation with apertures 44, securely lock the plastic hand grip member 38 in position over the edge portion 36*a* of wall 32 defined by the upper extremity by aperture 36. As indicated in FIG. 4, the lower edges of gripping member 38 are rounded to provide comfortable gripping of the safety cap in the manner shown in FIG. 4.

Figure 5:
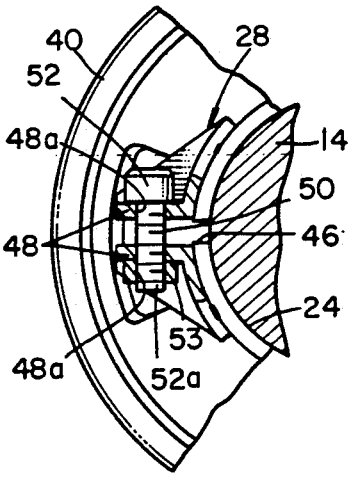
FIG. 5 is a fragmentary view taken along lines 5—5 of FIG. 4.

Turning now to FIGS. 2 and 5, the lower cylindrically shaped portion 22 of the device of the invention is provided with a vertically extending slit 46. Connected to cylindrical portion 22 on opposite sides of slit 46 is a pair of outwardly extending apertured ears 48. Apertures 48*a* in ears 48 closely receive a connector means, or bolt 50 having a head portion 52 adapted to engage the outer face of one ear 48 and a threaded shank portion 52*a*. Shank portion 52*a* receives a nut 53 which is in engagement with the outer face of the other ear 48. Ears 48, along with bolt 50 and nut 53, comprise portions of the adjustment means of the embodiment of the invention shown in the drawings. By tightening nut 53 on bolt 50, it is apparent that the width of slot 46 can be slightly narrowed thereby decreasing the size of the second opening 30 in the safety cap. As previously mentioned the adjustment means of the invention permits fine adjustments to be made to the size of the second opening so that the device can be properly threadably interconnected with the threads 26 provided on the gas cylinder. When necessary the adjustment means can also be used to lock the cap in place on the cylinder.

In using the device of the present invention, the lower, or second portion of the device, is threadably interconnected with the threads 26 provided on the gas cylinder. The device is then turned so that aperture 36 is positioned opposite the cylinder valve provided on the gas cylinder. If necessary, nut 53 can be tightened on bolt 50 to lock the cap securely in this position. With the cap thusly oriented, the cylinder valve of the gas cylinder is readily accessible without the necessity of removing the safety cap from the gas cylinder.

Figure 6:
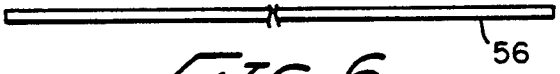
FIG. 6 is a side elevational view of the starting, planar workpiece used in the method of fabricating the safety cap of the present invention.

A unique feature of the device of the present invention resides in the fact that the entire device, save for the adjustment means, can be constructed from a single sheet of planar starting material identified in FIG. 6 by the numeral 56. The various steps in the method of making the safety cap of the invention are illustrated in FIGS. 6 through 20 and will be described in the paragraphs which follow.

Figure 7:
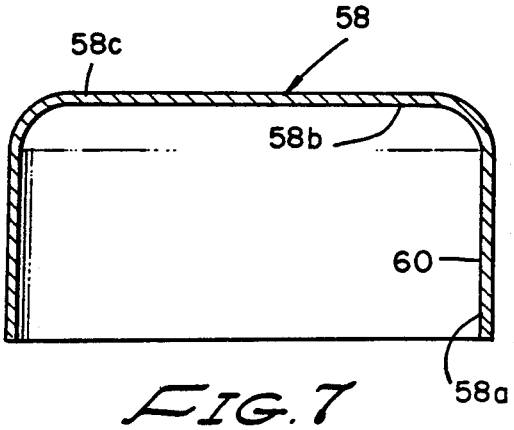
FIG. 7 is a side elevational view illustrating the accomplishment of the first step of the method of the invention.
Figure 8:
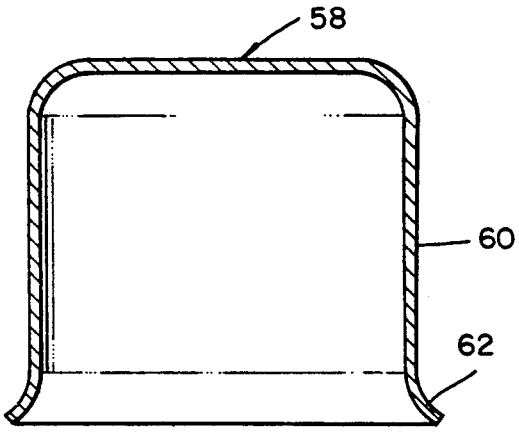
FIG. 8 is a cross sectional side elevational view illustrating the second step of the method of the invention.
Figure 9:
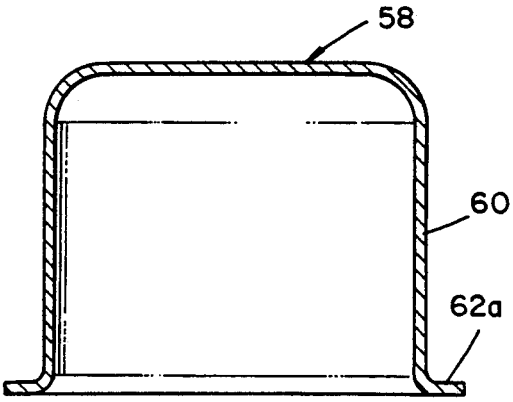
FIG. 9 is a cross sectional side elevational view illustrating the third step of the method of forming the safety cap of the present invention.
Figure 10:
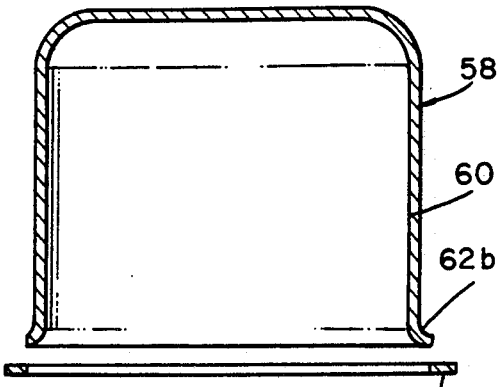
FIG. 10 is a side elevational cross sectional view illustrating the fourth step of the method of the invention.

Starting with the planar sheet 56, the first step in the method of the invention is to draw the starting material into a cup shaped body 58 of the character shown in FIG. 7. Cup shaped body 58 has an open first end 58*a* and a second end 58*b* closed by a top wall 58*c*. A side wall 60 interconnects first and second ends 58*a* and 58*b*.

By a second drawing step a flange 62 is then formed about the open end of the cup shaped body. Following the second draw the flanged, cup-shaped configuration is then restruck to flatten the flange into the configuration identified in FIG. 9 by the numeral 62*a*. This done, the flange 62*a* is trimmed in the manner shown in FIG. 10 to form a foreshortened flange 62*b*. The annular shaped material trimmed from the configuration, designated in FIG. 10 by the numeral 63, is discarded. Following the trim step the lower margin of the cup shaped member is curled to form a peripherally extending rounded bead 64.

Figure 11:
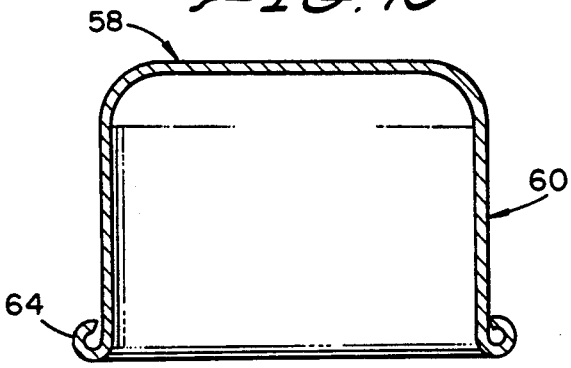
FIG. 11 is a side elevational cross sectional view illustrating the fifth step of the method of the invention.
Figure 12:
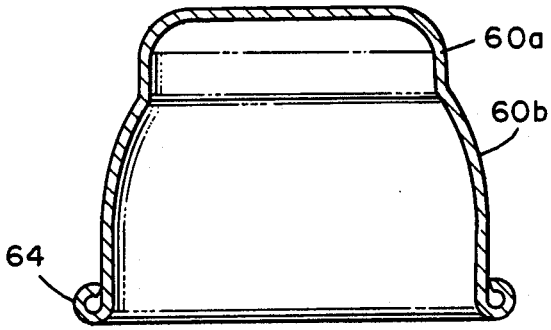
FIG. 12 is a side elevational cross sectional view illustrating the sixth step of the method of the invention.

The semi-finished product, shown in FIG. 11, is then subjected to a third drawing step wherein the upper portion 60*a* is roughly formed into a general cylindrical shape and the lower portion 60*b* is roughly formed into a general bell-shaped configuration. Upon completion of the third draw, a fourth draw is undertaken during which the configuration shown in FIG. 12 is drawn to the configuration shown in FIG. 13. In this step portion 60*a* is formed into a generally cylindrical shaped portion 66 which is foreshortened and has a diameter less than the diameter of the upper portion 60*a*. At the same time that portion 66 is being formed, portion 60*b* is refined into a more elongated bell-shaped portion 68 having an opening 69 which is coaxially aligned with portion 66. At the completion of the fourth drawing step to form the configuration shown in FIG. 13, it is apparent that the interim product has taken on the general exterior shape of the finished device of the invention.

Figure 13:
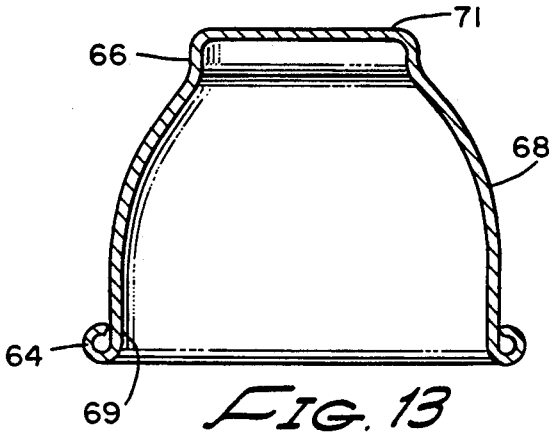
FIG. 13 is a side elevational cross sectional view illustrating the seventh step of the method of the invention.
Figure 14:
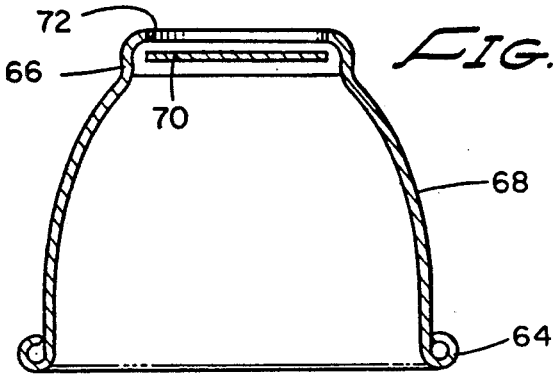
FIG. 14 is a side elevational cross sectional view illustrating the eighth step of the method of the invention.
Figure 18:
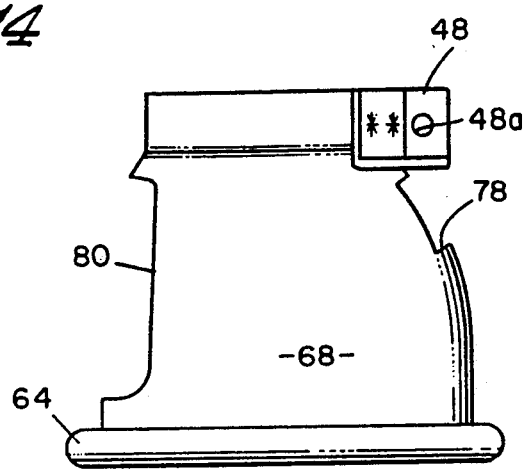
FIG. 18 is a side elevational view of the safety cap of the invention illustrating the twelfth step of the method of the invention.
Figure 14A:
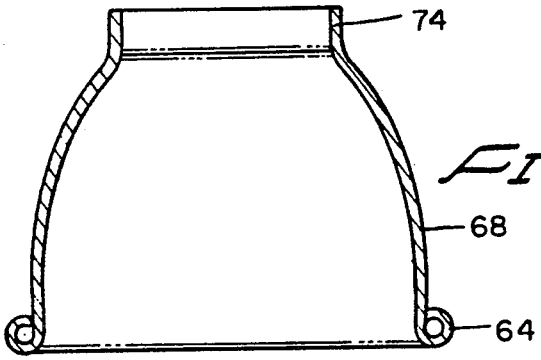

Following the fourth drawing step, as described in the preceding paragraph, the configuration shown in FIG. 13 is placed within an appropriate piercing mechanism so that the central portion 70 of the upper wall 71 of the configuration shown in FIG. 13 is cut away to define a generally circular opening 72 of a predetermined internal diameter. Following the piercing step, is a deburring step which results in the reforming of upper portion 66 into a cylindrical section 74 of the character shown in FIG. 15. The internal diameter of cylindrical section 74 is slightly greater than the diameter of aperture 72 formed in the piercing step.

Figure 16:
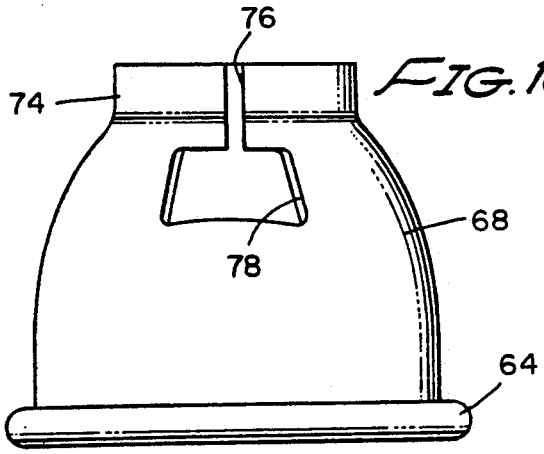
FIG. 16 is a rear elevational view of the partially formed safety cap of the invention illustrating the tenth step of the method of the invention.
Figure 17:
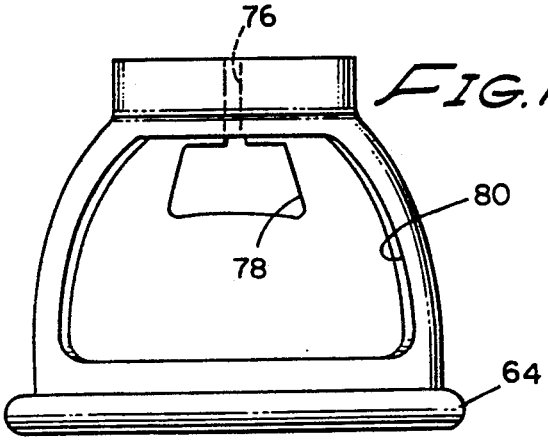
FIG. 17 is a front elevational view of the partially fabricated safety cap illustrating the eleventh step of the method of the invention.
Figure 20:
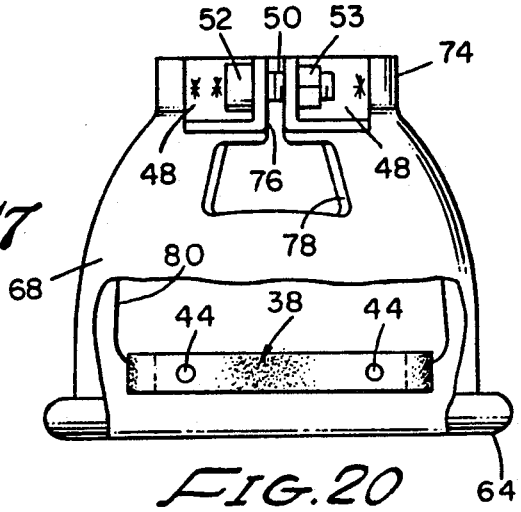
FIG. 20 is a view taken along lines 20—20 and partly broken away to better illustrate the configuration of the finished form of the safety cap of the invention and to illustrate the fourteenth step of the method of the invention.

The interim configuration shown in FIG. 15 is next subjected to a piercing step wherein a slot 76 is formed in cylindrical section 74 and at the same time an aperture 78 is formed in wall 68. As indicated in FIG. 16, slot 76 extends throughout the length of cylindrical section 74 and joins aperture 78. Following the first side piercing step just described, the opposite side of the interim work piece is pierced to form a second aperture 80 which is of a considerably larger size than aperture 78. A comparison of the configuration of the interim article, shown in FIG. 17, with the general configuration of the finished article, shown in FIG. 1, reveals that the basic internal and external configuration of the device of the apparatus has thus been formed from the single planar sheet of material 56 through a series of sequential forming, piercing and deburring steps.

Figure 19:
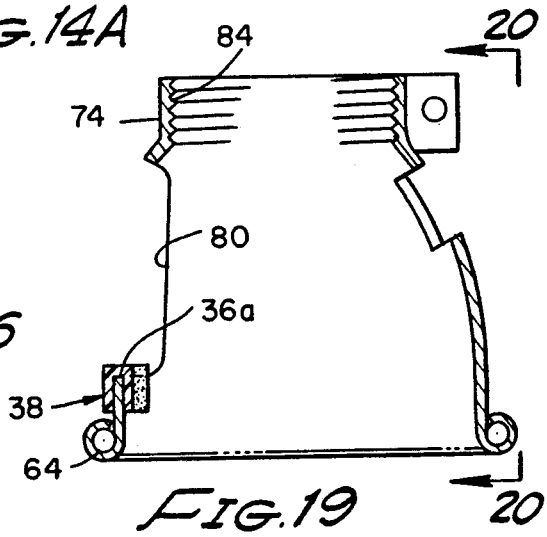
FIG. 19 is a side elevational cross sectional view of the safety cap of the invention illustrating the thirteenth of the method of the invention.

The next step in the method of the present invention involves the interconnection of the outwardly extending ears 48 to cylindrical section 74 on either side of slot 76. Ears 48 are affixed to the cylindrical section 74 by any suitable means such as spot welding. Following affixing of ears 48, which form a part of the adjustment means of the invention, the inner surface of cylindrical section 34 is threaded to form internal threads 84 of the character shown in FIG. 19. Following the threading step, the previously identified protruderences 42 are formed proximate the edge of aperture 80 and the finger engaging means, or elongated member 38, is snapped into position over the edge 36*a* of the aperture 80 (FIG. 19).

As a final step bolt 50 is inserted through the apertures 48*a* formed in the outwardingly extending ears, and nut 53 is threaded onto the threaded shank of the connector, or bolt 50. Comparing the finished article shown in FIG. 20 with the device of the invention shown in FIG. 1, it is to understood that the cylindrical portion 74 corresponds with upper portion 22; the internal opening 69 corresponds with opening 20; bell-shaped side wall 68 corresponds with wall 32; aperture 34 corresponds with aperture 78; and aperture 36 corresponds with aperture 80.

It is readily apparent the the method of the invention, as described in the proceeding paragraphs, permits the cylinder cap of the invention to be produced more expeditiously and considerably less expensively than the prior art cylinder caps generally in use.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A safety cap for use in connection with a cylinder for containing a compressed gas, said safety cap comprising a generally bell shaped body, including:
(a) a first end having a first opening of a first size, having a continuous peripheral edge;
(b) a generally cylindrically shaped second end having a second opening of a second size smaller than said first size, said second end being internally threaded for interconnection with said cylinder;
(c) a curved side wall interconnecting said first and second ends, said curved side wall having a first aperture, and a second oppositely disposed larger aperture; and
(d) adjustment means for adjusting the size of said second opening.

2. A safety cap as defined in claim 1 in which said generally cylindrically shaped second end is provided with an axially extending slit proximate said second opening and in which said adjustment means comprises:
(a) a pair of ears connected to said curved side wall and extending radially outwardly therefrom on opposite sides of said slit: and
(b) connector means operably associated with said ears for controllably urging said ears toward one another, whereby said slit is narrowed.

3. A safety cap as defined in claim 2, further including finger engaging means disposed within said first aperture for engagement with the fingers of a person lifting said safety cap.

4. A safety cap for use in connection with a cylinder for containing a compressed gas, said safety cap comprising a generally bell shaped body, including:
(a) a first end having a first opening of a first size, said first end being generally circular in shape and including a including a peripherally extending rounded bead;
(b) a generally cylindrically shaped second end having a second opening of a second size smaller than said first size, said second end being internally threaded for interconnection with said cylinder;
(c) a curved side wall interconnecting said first and second ends, said curved side wall having a first aperture and a second oppositely disposed larger aperture, said second aperture having an edge portion disposed proximate said rounded bead;
(d) adjustment means for adjusting the size of said second opening; and
(e) gripping means disposed within said second aperture proximate said edge portion for engagement by the fingers of a person lifting the cylinder.

5. A safety cap as defined in claim 4 in which said gripping means comprises a gripping member having a slot receivable over said edge portion of said second aperture.

6. A safety cap as defined in claim 5 in which said gripping member is provided with securement means for securing said member within said second aperture.

7. A safety cap as defined in claim 6 in which said curved side wall of said body is provided with a pair of protuberances and in which said securement means comprises a pair of apertures formed within said gripping member for closely receiving said protuberances.

* * * * *